US005911170A

United States Patent [19]

Ding

[11] Patent Number: 5,911,170

[45] Date of Patent: Jun. 8, 1999

[54] SYNTHESIS OF ACOUSTIC WAVEFORMS BASED ON PARAMETRIC MODELING

[75] Inventor: Yinong Ding, Plano, Tex.

[73] Assignee: Texas Instruments Incorporated, Dallas, Tex.

[21] Appl. No.: 09/031,808

[22] Filed: Feb. 27, 1998

Related U.S. Application Data

[60] Provisional application No. 60/039,580, Feb. 28, 1997.

[51] Int. Cl.[6] ..... G10H 1/057; G10H 1/12

[52] U.S. Cl. ..... 84/661; 84/663; 84/DIG. 9

[58] Field of Search ..... 84/622–625, 627, 84/661, 663, DIG. 9

[56] References Cited

PUBLICATIONS

Robert J. McAulay, et al., "Speech Analysis/Synthesis Based on a Sinusoidal Representation," IEEE Transactions on Acoustics, Speech, and Signal Processing, vol. ASSP–34, No. 4, Aug. 1986, pp. 744–754.

Thomas F. Quatieri, et al., "Speech Transformations Based on a Sinusoidal Representation," IEEE Transactions on Acoustics, Speech and Signal Processing, vol. ASSP–34, No. 6, Dec. 1986, pp. 1449–1464.

*Primary Examiner*—Stanley J. Witkowski

*Attorney, Agent, or Firm*—Warren L. Franz; Wade James Brady, III; Richard L. Donaldson

[57] ABSTRACT

A method is disclosed for synthesizing acoustic waveforms, especially musical instrument sounds. The acoustic waveforms are characterized by time-varying amplitudes, frequencies and phases of sinusoidal components. These time-varying parameters, at each analysis frame, are obtained in one embodiment by short term Fourier transforms (STFT). The spectrum envelope at each frame is parameterized with an autoregressive moving average model and applied to a waveform consisting of unit amplitude sinusoids via time-domain filtering. The resulting synthetic waveform preserves the time-varying frequency and phase information and has the same relative energy distribution among different sinusoidal components as that of the original signal. Finally, a general waveform shape for the type of acoustic signal being synthesized is applied. This is particularly useful when musical instrument sounds are being synthesized, where the commonly used four piecewise-linear attack-decay-sustain-release (ADSR) envelope model can be employed.

8 Claims, 2 Drawing Sheets

SYNTHESIS OF ACOUSTIC WAVEFORMS BASED ON PARAMETRIC MODELING

This application claims priority under 35 U.S.C. §119(e) (1) of provisional application Ser. No. 60/039,580 filed Feb. 28, 1997, entitled "Synthesis of Acoustic Waveforms Based on Parametric Modeling," the entirety of which is incorporated herein by reference.

The present invention relates to methods and apparatus for synthesizing acoustic waveforms, especially for synthesizing musical instrument sounds.

BACKGROUND OF THE INVENTION

Synthesis of acoustic waveforms has applications in speech and musical processing. When an acoustic waveform is parametrically represented (e.g. modeled as a sum of sinusoids with time-varying amplitudes, frequencies and phases), data reduction, effective modification of time and frequency (pitch) and flexible control for the resynthesis of the waveform can be achieved.

In the field of speech signal processing, research on the synthesis and coding of speech signals has been motivated by the speech production model, where the speech waveform s(t) is assumed to be the output of passing a glottal excitation waveform e(t) through a linear time-varying system with frequency response H(f, t), representing the characteristics of the vocal tract. The excitation waveform e(t) can be modeled as a sum of sinusoids. From this speech production model, the so-called source-filter model (SFM) for speech synthesis follows naturally, as shown in FIG. 1. See, McAulay et al., "Speech Analysis/synthesis Based on Sinusoidal Represention," *IEEE Transactions on Acoustics, Speech, and Signal Processing*, Vol. ASSP-34, pp. 744–754, Aug. 1986; and Quatieri et al., "Speech Transformations Based on a Sinusoidal Representation," *IEEE Transactions on Acoustics, Speech, and Signal Processing*, Vol. ASSP-34, pp. 1449-1464, Dec. 1986. As indicated in FIG. 1, the sinusoidal parameters, i.e., the time-varying amplitudes $a_k(t)$, frequencies $f_k(t)$ and phases $\phi_k(t)$, k=1, 2, . . . , L(m), where L(m) is the number of sinusoids at frame m, and the frequency responses of the vocal tract $H(f_k,t)$ are all jointly estimated during the analysis of the original speech signal.

The source-filter model has several disadvantages when used for synthesizing usical instrument sounds. First, according to Quatieri et al., above, the filtering of the excitation through the vocal tract model filter is done in the frequency domain and the frequency responses $H(f_k, t)$ are stored. However, due to the need for frequency modification (pitch transposition) with musical instrument sounds, either more frequency response points will have to be stored or additional frequency response values will have to be calculated using interpolation. This results in an increase in the amount of data storage or a requirement for the performance of additional computations. Second, because of dynamic change in amplitude of each individual sinusoid, the quality of the resulting acoustic waveform is more sensitive to the possible phase discontinuities at frame boundaries. Third, when L(m) is large, the computational requirement of the source-filter model is difficult to meet for real-time implementation using existing low cost programmable digital signal processors (DSPs). Finally, the speech production model does not apply for music synthesis, and there is no justification for extracting an excitation and vocal tract type filter from a musical instrument sound.

SUMMARY OF THE INVENTION

The invention provides a novel approach to synthesizing acoustic waveforms which are modeled as a sum of sinusoids that is particularly useful for the synthesis of musical instrument sounds.

In accordance with the invention, acoustic waveforms modeled as a sum of sinusoids are synthesized using an oscillator-filter envelope (OFE) model synthesis.

BRIEF DESCRIPTION OF THE DRAWINGS

Embodiments of the invention have been chosen for purposes of illustration and description and are described with reference to the accompanying drawings, wherein.

DETAILED DESCRIPTION OF PREFERRED EMBODIMENTS

Figure 1:
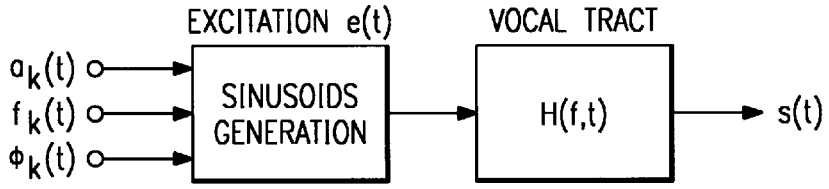
FIG. 1 (PRIOR ART)
FIG. 1 is a block diagram of a conventional speech synthesis system based on a sinusoidal representation.
Figure 2:
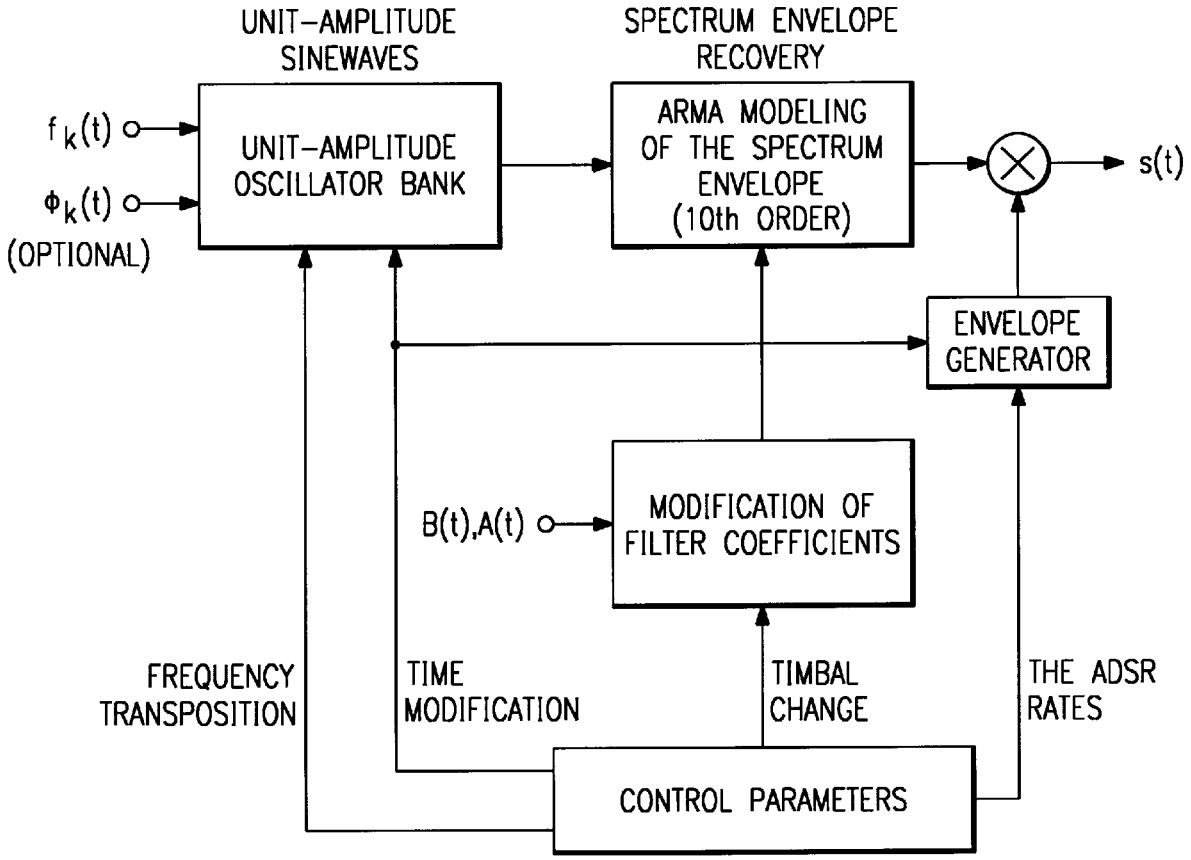
FIG. 2 is a block diagram of an OFE model synthesis system in accordance with the invention.
Figure 3:
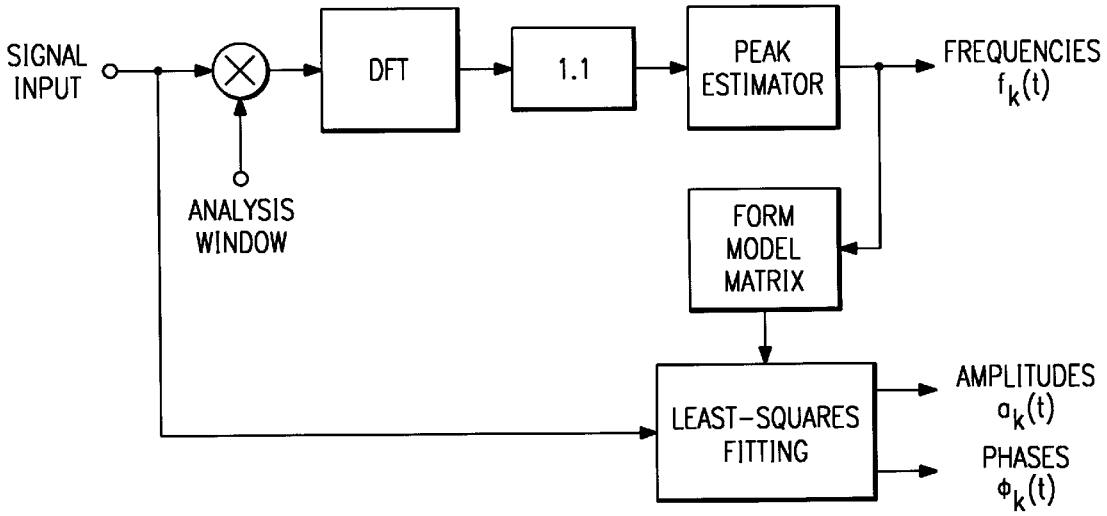
FIG. 3 is a block diagram of a DFT-based analysis process for obtaining the time-varying sinusoidal parameters for the system of FIG. 2.

A block diagram of an exemplary implementation of the inventive oscillator-filter envelope (OFE) approach, applied to synthesizing musical instrument sounds, is shown in FIG. 2. In FIG. 2, B(t) and A(t) are the numerator and denominator coefficient vectors, respectively, of the time-varying autoregressive moving average (ARMA) filters. The frequency response of the ARMA filter represented by B(m) and A(m) is a good approximation to the spectrum envelope of the acoustic waveform of the mth frame.

Analysis

Let s(t) represent the acoustic signal of interest. The sampled version of s(t) can be modeled as the sum of sinusoids:

$$s(n) = \sum_{k=1}^{L} a_k \cos(\omega_k n + \phi_k), \quad n = 0, 1, \ldots, N, \tag{1}$$

where $a_k$, $\omega_k$are the amplitude, (angle) frequency and phase of the kth smusoid of s(t), respectively, and L is the number of sinusoids the signal s(t) contains. This can be further expanded, as follows:

$$\begin{aligned} s(n) &= \sum_{k=1}^{L} a_k \cos(\omega_k n + \phi_k), \\ &= \sum_{k=1}^{L} a_k (\cos\omega_k n \cos\phi_k - \sin\omega_k n \sin\phi_k), \\ &= \sum_{k=1}^{L} (c_k^r \cos\omega_k n - c_k^i \sin\omega_k n), \end{aligned} \tag{2}$$

where $c^r_k = a_k \cos \Phi_k$ and $c^1_k = a_k \sin \Phi_k$.

Equation (2) can be written in matrix form as follows:

$$s = [\,A_c \quad A_s\,]\begin{bmatrix} c^r \\ c^i \end{bmatrix} = A \cdot c \tag{3}$$

where A is called the model matrix of s(n), $$A_c = \begin{bmatrix} 1 & \cdots & 1 \\ \cos\omega_1 \cdot 1 & \cdots & \cos\omega_L \cdot 1 \\ \vdots & \iddots & \vdots \\ \cos\omega_1 \cdot (N-1) & \cdots & \cos\omega_L \cdot (N-1) \end{bmatrix}, \tag{4}$$

$$A_s = \begin{bmatrix} 1 & \cdots & 1 \\ \sin\omega_1 \cdot 1 & \cdots & \sin\omega_L \cdot 1 \\ \vdots & \iddots & \vdots \\ \sin\omega_1 \cdot (N-1) & \cdots & \sin\omega_L \cdot (N-1) \end{bmatrix}, \text{ and}$$

$$c^r = [\,c_1^r \;\cdots\; c_L^r\,]^T, \text{ and } c^i = [\,c_1^i \;\cdots\; c_L^i\,]^T,$$

wherein $[\ldots]^T$ denotes the matrix transpose. Assuming the maximal likelihood estimates of $\omega_1, \omega_2, \ldots \omega_L$ are available, then the maximal likelihood estimate of c can be obtained by substituting the estimates of $\omega_1, \omega_2, \ldots, \omega_L$ into equation (4), and solving equation (3) for c in a least squares sense, i.e., c=A†s, where A† is the pseudo-inverse of A. The amplitude and phase of the kth component of s(t) are given by the following:

$$a_k = \sqrt{(c_k^r)^2 + (c_k^i)^2}, \quad \phi_k = \arctan\left(-\frac{c_k^r}{c_k^i}\right). \tag{5}$$

In order to account for the time-varying nature of real-world acoustic signals, the above analysis is often performed on a frame-by-frame basis. The short time Fourier transform (STFT) provides an effective way to obtain the frequency estimates. It is well known that the discrete Fourier transform (DFT) gives the maximal likelihood estimates of frequencies in the sequence of $N_a$ data samples, provided that the frequencies of any two sinusoids are at least $1/N_a$ apart, which is about 27.5 Hz if $N_a$=256 and the sampling rate is 44.1 kHz. This means that for harmonic signals sampled at 44.1 kHz, their frequency components are identifiable by DFT if the frame length can be chosen to be 256 and their fundamental frequencies (pitches) are higher than 27.5 Hz. These requirements are met by a majority of acoustic signals of interest, including most musical instrument sounds.

Figure 4:
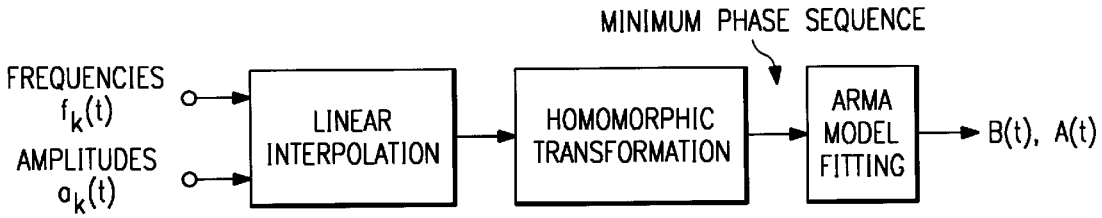
FIG. 4 is a schematic diagram of the spectrum envelope modeling process for the system of FIG. 2.

It has been observed that the spectrum envelope of an acoustical waveform reflects some important characteristics of the signal, e.g., the musical timbre in the case of instrument sounds. It is thus desirable to be able to extract the envelope and use it for synthesis and control. The approach used here to extract the spectrum envelope of an acoustical signal is shown in FIG. 4. A 10th order ARMA model can be used to fit the spectrum envelopes of instrument sounds.

Synthesis

The first step of the synthesis is to generate the unit-amplitude sinewaves from the analysis data. The benefit of generating unit or constant amplitude sinewaves versus sinewaves with dynamically changed amplitudes is two-fold: First, it is computationally more efficient. After taking into account the computations required for the filtering that follows, more than 40% savings in computation can be achieved. (This savings calculation is based on the assumptions that the average number of sinusoids is 40—the value of L in equation (1)—and that the cubic phase interpolation algorithm proposed in McAulay et al., above, is used for generating sinusoids with time-varying parameters. The greater the number of sinusoids, the greater the savings in computation.) Second, the perceptual quality of the constant amplitude sinusoids is less sensitive to a certain amount of phase discontinuity at frame boundaries than that of the sinusoids with changing amplitudes. This observation makes the input of the phase information to the oscillator bank in FIG. 2 optional and thus further reduces the amount of computation in some scenarios.

The output of the oscillator bank is then fed into the ARMA filter whose frequency response has the same shape as the spectrum envelope of the signal being synthesized. The "flat" spectrum of the input is "weighted" so that the relative magnitudes of different frequency components are restored. Note that since the recovery of the spectrum envelope is done by time-domain filtering, only 20 real coefficients need be stored for a 10th order ARMA filter regardless of the number of sinusoids present in the synthesized signal, and there is no need to store the magnitudes of sinusoidal components. The use of this ARMA filter also makes the independent control over the spectrum envelope of the synthesized signal possible.

The last step in the synthesis is to apply an envelope to the synthesized signal. For music synthesis, a commonly used four piecewise linear attack-decay-sustain-release model can be employed. The capability of applying a required envelope provides a flexible control to the loudness and other perceptually important parameters of the signal.

What is claimed is:

1. A method of synthesizing an acoustic waveform modeled as a sum of sinusoids with time-varying amplitudes and frequencies, comprising:

generating a flat spectrum signal comprising a sum of constant amplitude sinusoids with time-varying frequencies using a cubic phase interpolation algorithm with frequency parameter inputs $f_k$ (t) derived from DFT-based analysis of sampled waveform data;

generating a weighted spectrum signal comprising a sum of time-varying relative magnitudes of different frequency components by filtering the flat spectrum signal using an autoregressive moving average (ARMA) filter whose inputs B(t), A(t) are derived from spectrum envelope shape analysis of the sampled waveform data; and applying an overall time-varying amplitude envelope to the weighted spectrum signal.

2. The method of claim 1, wherein the flat signal spectrum generating step comprises generating a sum of unit amplitude sinusoids.

3. The method of claim 1, wherein the overall time-varying amplitude envelope is a four piecewise linear attack-decay-sustain-release model.

4. The method of claim 1, wherein the frequency parameter inputs $f_k$ (t) are derived from the DFT maximal likelihood estimates obtained from a sequence frames of 256 data samples each obtained from sampling a musical instrument sound waveform at a sampling rate of 44.1kHz.

5. The method of claim 1, wherein the filter inputs B(t), A(t) are derived from linear interpolation, homomorphic transformation and ARMA model fitting using amplitude parameter inputs $a_k$ (t) derived by least-squares fitting of the sampled waveform data using a form model matrix derived from the frequency parameter inputs $f_k$ (t).

6. A method of synthesizing an acoustic waveform modeled as a sum of sinusoids with time-varying amplitudes and frequencies, comprising:

generating a flat spectrum signal comprising a sum of constant amplitude sinusoids with time-varying frequencies using a cubic phase interpolation algorithm with frequency parameter inputs $f_k$ (t) derived from DFT maximal likelihood estimates of a sampled musical instrument sound waveform;

generating a weighted spectrum signal comprising a sum of time-varying relative magnitudes of different frequency components by filtering the flat spectrum signal using an autoregressive moving average (ARMA) filter whose inputs B(t), A(t) are derived from linear interpolation, homomorphic transformation and ARMA model fitting using amplitude parameter inputs $a_k$ (t) derived by least-squares fitting of the sampled waveform data using a form model matrix derived from the frequency parameter inputs $f_k$ (t); and applying piecewise linear attack-decay-sustain-release overall time-varying amplitude model envelope to the weighted spectrum signal.

7. The method of claim 6, wherein the flat signal spectrum generating step comprises generating a sum of unit amplitude sinusoids.

8. The method of claim 7, wherein the frequency parameter inputs $f_k$ (t) are derived from the DFT maximal likelihood estimates obtained from a sequence frames of 256 data samples each obtained from sampling a musical instrument sound waveform at a sampling rate of 44.1kHz.

* * * * *